United States Patent [19]

Bowerman et al.

[11] 4,098,011

[45] Jul. 4, 1978

[54] CLEATED SOLE FOR ATHLETIC SHOE

[75] Inventors: William J. Bowerman; Stanley L. James; Dennis E. Vixie, all of Eugene, Oreg.

[73] Assignee: BRS, Inc., Beaverton, Oreg.

[21] Appl. No.: 791,495

[22] Filed: Apr. 27, 1977

[51] Int. Cl.[2] ..... A43B 5/00

[52] U.S. Cl. ..... 36/129; 36/32 R; 36/59 R

[58] Field of Search ..... 36/32 R, 59 R, 59 C, 36/127, 128, 129, 28; D2/320

[56] References Cited

U.S. PATENT DOCUMENTS

| | | | |
|---|---|---|---|
| D. 119,290 | 3/1940 | Watanabe | D2/320 |
| 989,514 | 4/1911 | Sanford | 36/32 R X |
| 2,038,972 | 4/1936 | Watanabe | 36/32 R |
| 3,494,055 | 2/1970 | McSorley | 36/59 R |

FOREIGN PATENT DOCUMENTS

| | | | |
|---|---|---|---|
| 184,847 | 2/1956 | Austria | 36/59 R |
| 20,473 of | 1903 | United Kingdom | 36/59 R |

*Primary Examiner*—Alfred R. Guest

*Attorney, Agent, or Firm*—Klarquist, Sparkman, Campbell, Leigh, Hall & Whinston

[57] ABSTRACT

A cleated outer sole for an athletic shoe is described which includes two pairs of heel and toe cleats of large ground engaging surface area to provide a long wearing sole. These pairs of large cleats are surrounded by smaller gripping cleats of substantially the same height as such larger cleats and all cleats are molded of resilient material integral with the outer sole. The gripping cleats are in the shape of straight sided polygons such as a square or hexagon to provide superior traction and cushioning. The larger cleats are of a different shape and may be triangular, rectangular or other shapes. The pair of heel cleats is provided on opposite sides of the heel portion of the outer sole, while the pair of toe cleats may be provided on opposite sides of the front portion of such sole beneath the heads of the metatarsal bones of the foot. The heel cleat positioned on the inside edge of the shoe functions primarily to provide greater lateral stability to the shoe. The two heel wear cleats are of left and right allochiral shape so that the heel portion of the sole is substantially symmetrical about the longitudinal axis of the shoe. Also, the shoe is made with a straight last whose axis bisects the heel bone and passes through the head of the second metatarsal bone.

21 Claims, 10 Drawing Figures

FIG. 1
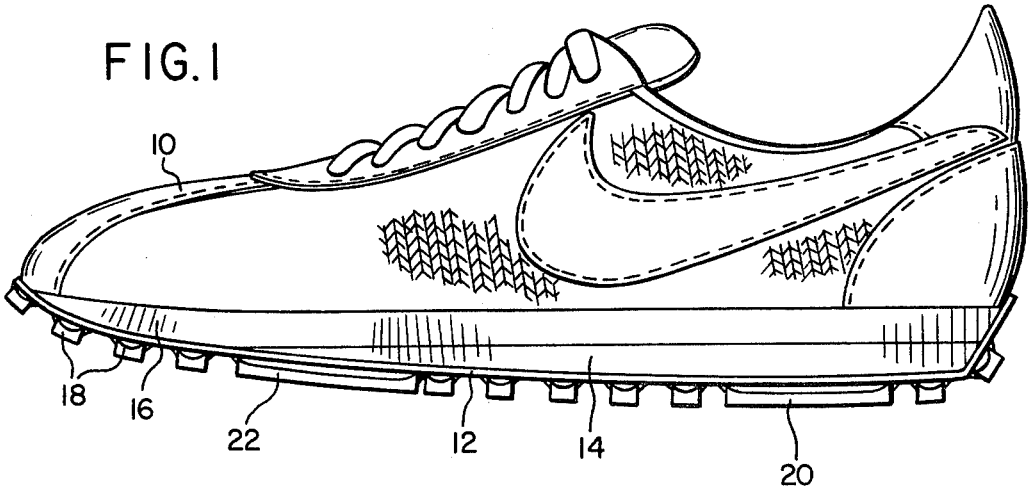
FIG. 2
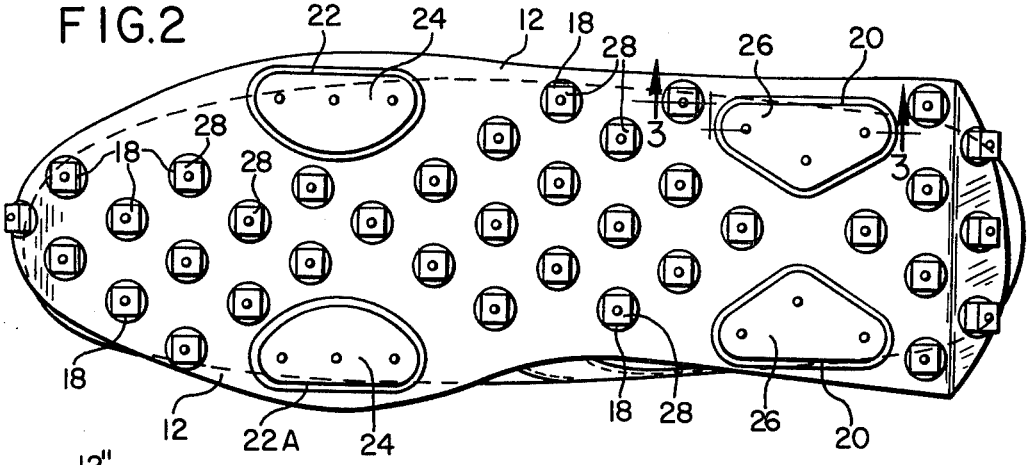
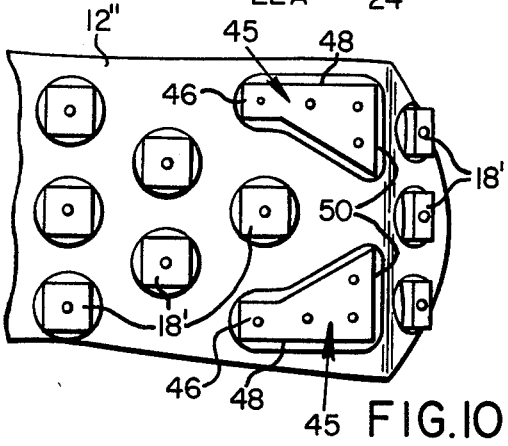
FIG. 10
FIG. 4
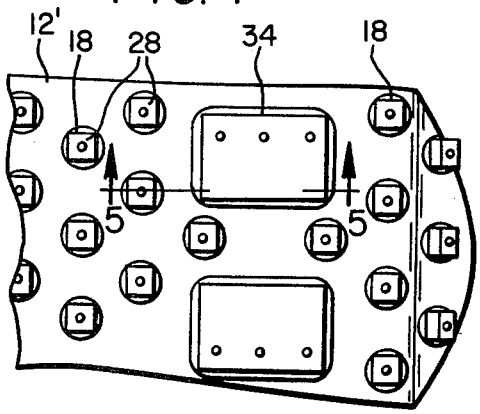
FIG. 3
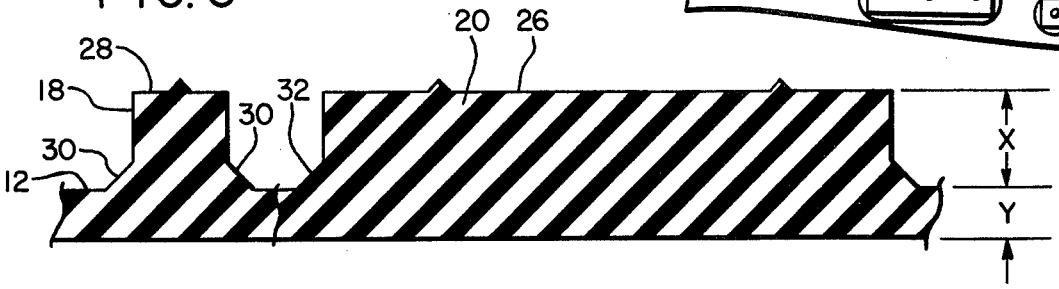

CLEATED SOLE FOR ATHLETIC SHOE

BACKGROUND OF INVENTION

The subject matter of the present invention relates generally to athletic shoes having cleated soles and in particular to such shoes in which the cleats are molded integral with the outer sole of the shoe of resilient material for superior traction and cushioning when used on artificial turf and other hard surfaces such as rubberized asphault tracks, streets, basketball floors, tennis courts, etc. The cleated sole of the present invention is provided with large area wear cleats at the opposite sides of the heel for longer wear and to provide greater lateral stability to prevent injury due to twisted ankles and the like. In addition, another pair of large area wear cleats may be provided on the opposite sides of the toe portion of the sole.

The shoe sole of the present invention is useful on many types of athletic shoes worn for sports such as track or jogging, requiring straight ahead running, and for sports also involving lateral movement such as football, soccer, baseball, basketball, tennis and golf. The sole is suitable for use on hard surfaces such as artificial turf as well as on natural grass or dirt since the cleats are designed to be self-cleaning.

It has previously been proposed in U.S. Pat. No. 3,793,750 of W. J. Bowerman, granted Feb. 26, 1974, to provide an athletic shoe suitable for use on artificial turf and other hard surfaces with an improved sole of studs or cleats of resilient material molded integral with the outer sole of the shoe of a polygon shape. While this shoe provides superior traction and cushioning when running on hard surfaces, its useful lifetime is somewhat limited because of undue wear of the sole, especially by some types of runners who drag their heels. In addition, such previous shoe has some lateral instability due to a shoe upper of synthetic fabric and a thick multi-layered sole, including a cushion midsole layer. This lateral instability was reduced by outwardly flaring the sides of the heel portion of the sole as shown in pending U.S. patent application Ser. No. 688,843 by G. L. Hollister et al, filed May 21, 1976, now U.S. Pat. No. 4,043,058, granted Aug. 23, 1977.

Both of the above problems have been solved by the sole of the present invention including a pair of heel cleats of larger area provided on the opposite sides of the heel portion of the sole and in some cases, a pair of toe cleats of large area on the opposite sides of the toe portion of such sole. Thus the large cleats provided on the outside edge of the sole prevent undue wear while the large cleats provided adjacent the inside edge of the sole function primarily to provide greater lateral stability. This has been accomplished while maintaining the superior cushioning and traction characteristics of the cleated sole of U.S. Pat. No. 3,793,750 and without adding any appreciable weight.

There have been other attempts to provide shoe soles for use on artificial turf including those employing cleats of cylindrical or conical shape molded integral with the outer sole, as shown in U.S. Pat. No. 3,932,950 of G. J. Taber, granted Jan. 20, 1976. However, such shoe also suffers from problems of undue wear and lateral instability. In addition, in order to provide adequate traction using round cleats, this shoe employs an extremely large number of small cleats closely spaced to one another which has the added disadvantage that such a sole becomes quickly clogged with dirt and grass when used on natural turf because such sole is not self-cleaning. Self-cleaning cleated soles for football shoes used on natural turf are old, as shown in U.S. Pat. No. 2,888,756 of N. B. Parsons, granted June 2, 1959. However, these soles are not suitable for artificial turf and other hard surfaces because they are molded of a rigid synthetic plastic material called "Neolite", and are provided with pointed edges as the ground engaging surfaces of such cleats, so they do not provide sufficient traction or cushioning.

SUMMARY OF INVENTION

It is therefore one object of the present invention to provide an improved athletic shoe having a cleated outer sole of superior traction and cushioning suitable for use on artificial turf and other hard surfaces which is long wearing.

Another object of the invention is to provide such an athletic shoe having greater lateral stability to prevent injury to the wearer's foot.

An additional object of the invention is to provide an improved sole for such an athletic shoe having two sets of cleats molded into its outer surface, one of which is of larger area than the other, including a pair of heel cleats provided on opposite sides of the heel portion of the sole to provide greater wear and lateral stability.

Still another object of the invention is to provide such an improved shoe sole suitable for use on natural turf as well in which the first and second sets of cleats are spaced apart sufficiently and are shaped to provide a self-cleaning sole which does not clog with dirt and grass.

A still further object of the present invention is to provide such an improved shoe sole which also includes a pair of toe cleats of larger area provided on opposite sides of the toe portion of the sole for longer wear.

DRAWINGS

Other objects and advantages of the present invention will be apparent from the following detailed description of certain preferred embodiments thereof and from the attached drawings of which:

FIG. 1 is a side elevation view of an athletic shoe made in accordance with the present invention;

FIG. 2 is a bottom plan view showing one embodiment of the shoe sole of the present invention;

FIG. 3 is an enlarged horizontal section view taken along line 3—3 of FIG. 1;

FIG. 4 is a partial bottom plan view of the heel portion of a second embodiment of the shoe sole of the present invention;

FIG. 10 is a partial bottom plan view of the heel portion of a fifth embodiment of the shoe sole.

DESCRIPTION OF PREFERRED EMBODIMENTS

Figure 8:
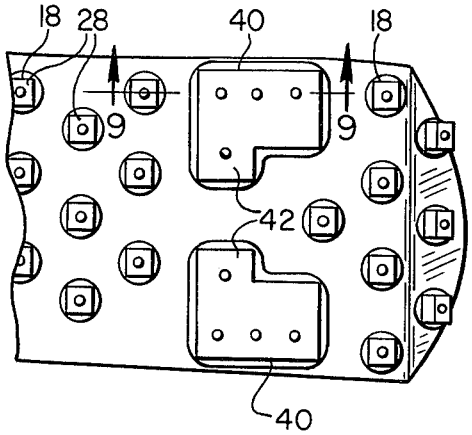
FIG. 8 is a partial bottom plan view of the heel portion of a fourth embodiment of the sole of the present invention.

As shown in FIG. 1, an athletic shoe made in accordance with the present invention includes a shoe upper 10 of leather, canvas or synthetic plastic fabric including the multi-layer nylon and intermediate plastic foam construction of U.S. Pat. 3,793,750. A multi-layered sole is attached to the bottom of shoe upper 10 including an outer sole 12, a heel lift sole layer 14 and a cushion midsole layer 16. The position of the heel lift layer 14 and the midsole layer 16 can be reversed, but they are always positioned between the shoe upper and the outer sole layer 12, which is of a harder, more wear resistant material than the foam rubber or foam plastic of sole layers 14 and 16.

As stated in the above-mentioned copending application Ser. No. 688,843, it is preferable to make the athletic shoe of the present invention with a straight last, whose last axis bisects the heel bone and passes through the head of the second metatarsal bone of the wearer's foot.

As shown in FIG. 2, the outer sole 12 includes a first set of cleats 18 molded integral with the outer sole of rubber or other suitable resilient material. The first cleats 18 are preferably of a straight sided polygon shape including not only the square shape shown in FIG. 2, but also triangular, hexagonal and other polygon shapes. The straight sides of cleats 18 grip the artificial turf or other hard surface to provide good traction in all directions to enable quick lateral movement as well as forward and backward movement.

A second set of cleats including a pair of heel cleats 20 and a pair of toe cleats 22, of larger size than the first cleats 18, are also molded integral with the outer sole 12. While the second cleats 20 and 22 may be made of a rubber harder than cleats 18 and the remainder of the outer sole, in most cases they are formed of the same resilient material for reasons of economy. As shown in FIG. 2, the pair of heel cleats 20 are preferably made of a rounded equilateral triangular shape with the base of such triangle positioned adjacent the side of the sole and its apex pointing inwardly toward the other heel cleat. Thus the two heel cleats 20 are of left and right allochiral shape and are symmetrical about the longitudinal axis of the heel portion of the sole.

The toe cleats 22 are of a generally rounded semicircular shape, different from that of the heel cleats. The toe cleats 22 are positioned so that they extend partially under the heads of the metatarsal bones at the opposite edges of the toe portion of the sole. These toe cleats and heel cleats are both of the same height as the first cleats 18, as shown in FIG. 3. However, the heel and toe cleats are provided with substantially flat ground engaging surfaces 24 and 26 respectively, which are over twice as great as the flat ground engaging surface 28 of the first cleat. The cleats are also provided with enlarged base portions 30 and 32 which taper outwardly where such base portions join the remaining portion of the outer sole layer surrounding such cleats to provide greater strength and self-cleaning of the cleats. The cleats 18, 20 and 22 project above the surrounding portion of the outer sole layer a distance, X, of about $\frac{1}{8}$ to $\frac{1}{4}$ inch, while the thickness, Y, of the surrounding portion of the outer sole layer is approximately 1/16 to $\frac{1}{8}$ inch. Thus the total height of the cleats is between about 3/16 and $\frac{3}{8}$ inch.

The spacing between the cleats varies depending upon the purpose that the shoe is used for, and depending upon whether the shoe is to be worn on artificial turf and other hard surfaces or natural turf. In the latter case the spacing must be wider in order to provide self-cleaning. As shown in FIG. 2, the distance between the cleats is preferably at least as great as the width of the first cleats 18. In the embodiments shown, the first cleats 18 are square cleats, approximately $\frac{1}{4}$ to $\frac{3}{8}$ inch square, while the triangular heel cleats 20 have a base of about $1\frac{1}{2}$ inches long and an apex of about 1 inch high, and the toe cleats 22 have a maximum longitudinal dimension of $1\frac{1}{2}$ inches and a minimum lateral dimension of $\frac{3}{4}$ inch.

While both of the heel cleats 20 are necessary for lateral stability and long wear, the inner toe cleat 22A adjacent the inside edge of the shoe is optional and may be eliminated in some cases.

Figure 5:
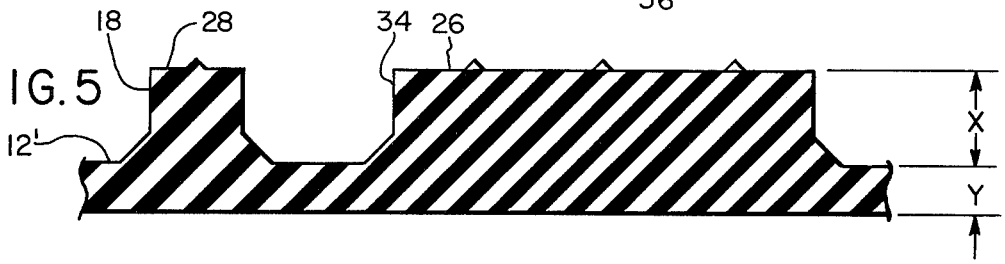
FIG. 5 is an enlarged horizontal section view taken along line 5—5 of FIG. 4.

As shown in FIGS. 4 and 5, the heel cleats may be a rectangular shaped cleat 34, as may be the toe cleat. However, the heel cleat 34 is still of much larger area many times greater than twice that of the first cleats 18. Thus the heel cleats 34 are $\frac{3}{4}$ inch wide and 1 inch long, while the first cleats 18 are approximately $\frac{1}{4}$ to $\frac{3}{8}$ inch square.

Figure 6:
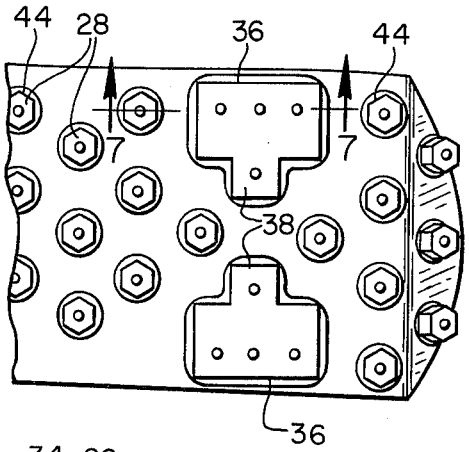
FIG. 6 is a partial bottom plan view of a portion of the heel portion of a third embodiment of the sole.
Figure 7:
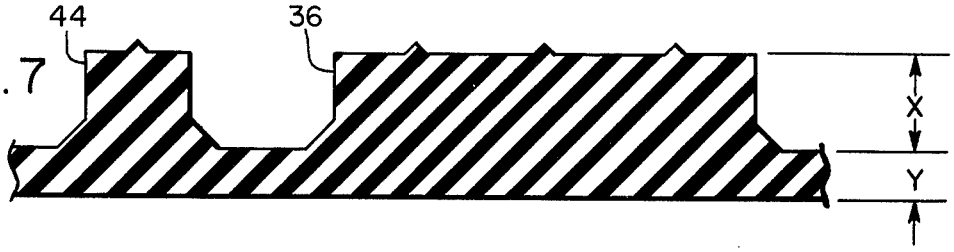
FIG. 7 is an enlarged horizontal section view taken along line 7—7 of FIG. 6.

A third embodiment of the heel cleat is shown in FIGS. 6 and 7 as cleats 36, which are provided with lateral projections 38 which extend inwardly from the rectangular major portions of such cleats. The rectangular portion of cleat 36 is substantially the same size as that of cleat 34 of FIG. 4. It is believed that the lateral projections 38 provide additional lateral stability. These lateral projections 38 extend out from the center of the inside edge of each of the rectangular portions of cleat 36.

Figure 9:
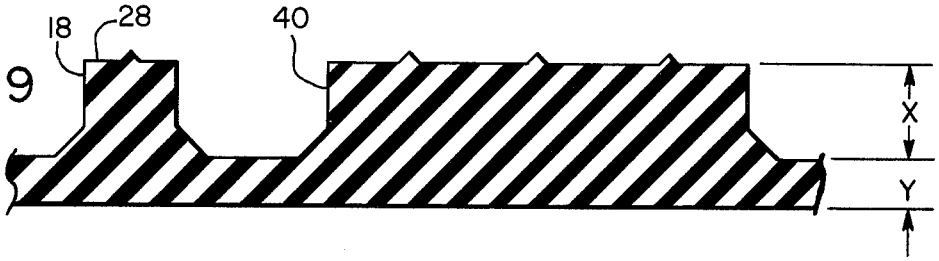
FIG. 9 is an enlarged horizontal section view taken along line 9—9 of FIG. 8.

Another embodiment of the heel cleat is shown as cleat 40 in FIGS. 8 and 9. In this embodiment, lateral projections 42 extend inwardly from the top of the rectangular portion of cleat 40. Thus cleats 40 are of a general L-shape.

A further embodiment of the invention is shown in FIG. 10 and includes a pair of heel cleats 45 which are in the general shape of right triangles except that a square end portion 46 is provided at the forward apex of the triangle. The end portion 46 is substantially the same size as the smaller first cleats 18' on the heel portion of the outer sole 12''. Also, the two legs 48 and 50 of the triangular cleat 45 are, respectively, about three times and twice the width of cleats 18'. The cross section of the cleats 45 and 18' of FIG. 10 are substantially the same as FIG. 3.

In all of the embodiments of FIGS. 6, 8 and 10, the major portion of the heel cleat with the largest longitudinal dimension is positioned adjacent the edge of the outer sole in order to provide greatest resistance to wear. This is also true of the embodiments of FIGS. 2 and 4.

Since the toe cleats 22 are positioned underneath the heads of the metatarsal bones, while the heel cleats 20 are positioned on opposite sides of the heel bone, these cleats are all positioned at the points of greatest wear.

In addition to the square shape of the first cleats 18 shown, other straight sided polygon shapes can be employed including the hexagon shaped cleats 44 shown in FIG. 6. Also, while the athletic shoe shown in FIG. 1 is designed primarily for track or jogging, the shoe sole of the present invention may be employed on other types of athletic shoes, including those used for football, baseball, soccer, basketball, golf and other sports as discussed previously.

It will be apparent to those having ordinary skill in the art that many changes may be made in the details of the above-described preferred embodiments of the present invention without departing from the spirit and scope of the invention. For example, other shapes may be employed for the cleats than those shown and described and toe cleats 22 can be eliminated. Therefore, the scope of the present invention should only be determined from the following claims.

We claim:

1. An athletic shoe designed for running in which the improvement comprises:

an outer sole having a plurality of cleats of resilient material molded integral with said sole and each cleat projecting downward from a base portion to a ground engaging surface at the bottom end of the cleat, said outer sole including an arch portion between a toe portion and a heel portion with the arch portion substantially in longitudinal alignment with the heel portion;

said cleats including a plurality of laterally spaced first cleats on each of the toe portion, arch portion and heel portion of said sole and a plurality of second cleats of larger size than said first cleats including one pair of second cleats on the heel portion whose ground engaging surfaces are in substantial alignment with those of the first cleats on said arch portion and heel portion; and said second cleats having larger area ground engaging surfaces than the first cleats on said heel portion but being of substantially the same height as said first cleats.

2. An athletic shoe in accordance with claim 1 in which the height of the cleats is greater than the thickness of the outer sole in the regions between said cleats.

3. An athletic shoe in accordance with claim 1 in which said second cleats include one pair of second cleats positioned respectively adjacent the outside edge and the inside edge of the heel portion of said sole.

4. An athletic shoe in accordance with claim 3 in which each of said second cleats of said one pair have more than twice the ground engaging surface area of said first cleats, said ground engaging surface being substantially flat.

5. An athletic shoe in accordance with claim 3 in which said second cleats include another pair of second cleats positioned respectively adjacent the outside edge and the inside edge of the toe portion of said sole under the heads of the metatarsal bones of the wearer's foot.

6. An athletic shoe in accordance with claim 3 in which said one pair of second cleats are of left and right allochiral shape.

7. An athletic shoe in accordance with claim 3 in which the ground engaging surface of each of said second cleats of said one pair is rectangular.

8. An athletic shoe in accordance with claim 3 in which the ground engaging surfaces of said second cleats of said one pair are each of a rounded triangular shape with its base positioned adjacent the edge of said sole and its apex pointing inwardly toward the other of said one pair of second cleats.

9. An athletic shoe in accordance with claim 1 in which said second cleats each include an inner portion and an outer portion, said outer portion being positioned adjacent the edge of said sole and being of greater width in the longitudinal direction of the sole than the width of the inner portion which is positioned inward of said outer portion away from said edge.

10. An athletic shoe in accordance with claim 1 in which the ground engaging surface of said first cleats is of a straight sided polygon shaped cross section different from the shape of said second cleats.

11. An athletic shoe in accordance with claim 1 in which said first cleats are of a square shape.

12. An athletic shoe in accordance with claim 1 in which said first cleats are of a hexagonal shape.

13. An athletic shoe in accordance with claim 1 in which the base portion tapers outward where it joins the sole, and the shoe has a straight last.

14. A shoe sole for an athletic shoe, comprising:

a sole member having a plurality of first and second cleats of resilient material molded integral therewith and including an arch portion between a toe portion and a heel portion with said arch portion being in longitudinal alignment with the heel portion;

said first cleats being provided as laterally spaced cleats on each of the heel portion, arch portion and the toe portion of said sole with the bottom ends of said first cleats on said arch portion and heel portion being in substantial alignment with the bottom ends of said second cleats on said heel portion; and said second cleats being of larger area than said first cleats and including one pair of second cleats provided on said heel portion so that one cleat of said pair is positioned adjacent the outside edge and the other cleat of said pair is adjacent the inside edge of said heel portion laterally spaced from said one cleat of said pair.

15. A sole in accordance with claim 14 in which the first and second cleats are of substantially the same height.

16. A sole in accordance with claim 14 in which said second cleats are each of more than twice the area of said first cleats.

17. A sole in accordance with claim 14 in which the second cleats include another pair of second cleats provided on the toe portion of said sole so that one of said another pair of second cleats is positioned adjacent the inner edge and the other of said another pair is positioned adjacent the outer edge of said toe portion.

18. A sole in accordance with claim 14 in which said one pair of second cleats are of left and right allochiral shape.

19. A sole in accordance with claim 18 in which said one pair of second cleats are each of a rounded triangular shape.

20. A sole in accordance with claim 14 in which said one pair of second cleats are each of a rectangular shape.

21. A sole in accordance with claim 14 in which said one pair of second cleats are each of a generally right triangular shape with the longer leg of the triangle extending longitudinally adjacent the side of the sole and the shorter leg of the triangle extending laterally adjacent the rear of the heel portion of the sole.

* * * * *